United States Patent [19]

Kyatt

[11] 4,375,819

[45] Mar. 8, 1983

[54] APPARATUS FOR CLEANING MACHINERY PARTS AND THE LIKE

[75] Inventor: Victor F. Kyatt, Birmingham, Ala.

[73] Assignee: Hurri-Kleen Corporation, Birmingham, Ala.

[21] Appl. No.: 255,289

[22] Filed: Apr. 17, 1981

[51] Int. Cl.[3] ..... B08B 3/10

[52] U.S. Cl. ..... 134/105; 134/194

[58] Field of Search ..... 134/105, 193, 194

[56] References Cited

U.S. PATENT DOCUMENTS 2,638,909 5/1953 Hiatt et al. ..... 134/194 X 3,111,952 11/1963 Roehl ..... 134/105

FOREIGN PATENT DOCUMENTS 210159 2/1956 Australia ..... 134/194

1131439 10/1968 United Kingdom ..... 134/193

*Primary Examiner*—Robert L. Bleutge

*Attorney, Agent, or Firm*—Woodford R. Thompson, Jr.

[57] ABSTRACT

A closed chamber adapted to receive a cleaning solution and machinery parts to be cleaned has a shaft extending through an opening in a sidewall of the chamber and carries a propeller at its inner end in position to circulate the cleaning solution in a horizontal plane relative to the parts to be cleaned. A heating element mounted within the chamber subjacent the propeller heats the cleaning solution. A seal assembly is mounted between the opening in the sidewall and the shaft to form a fluid tight seal therebetween.

3 Claims, 4 Drawing Figures

FIG. 1
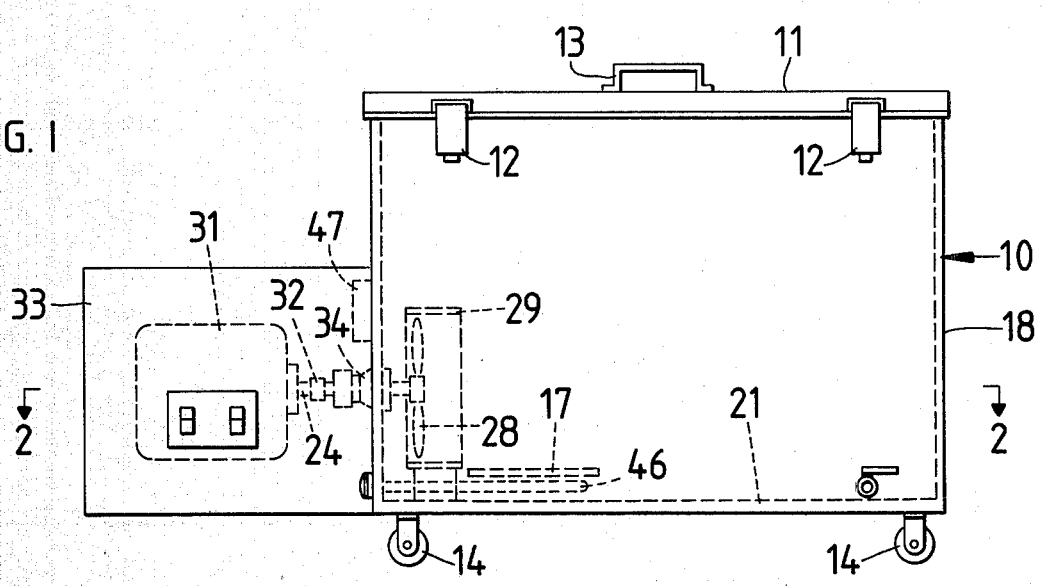
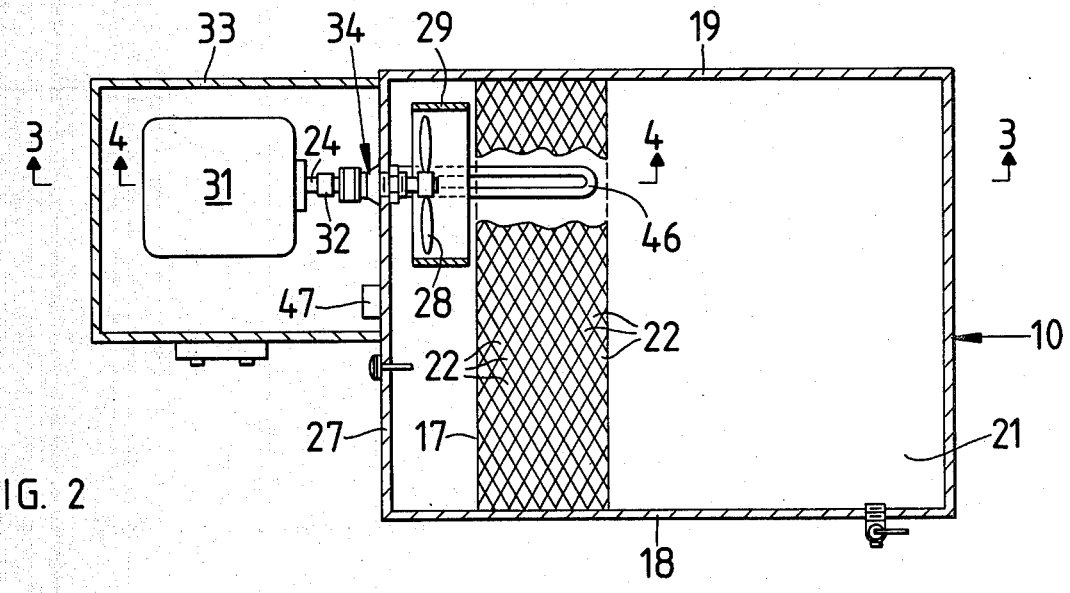
FIG. 2
FIG. 3
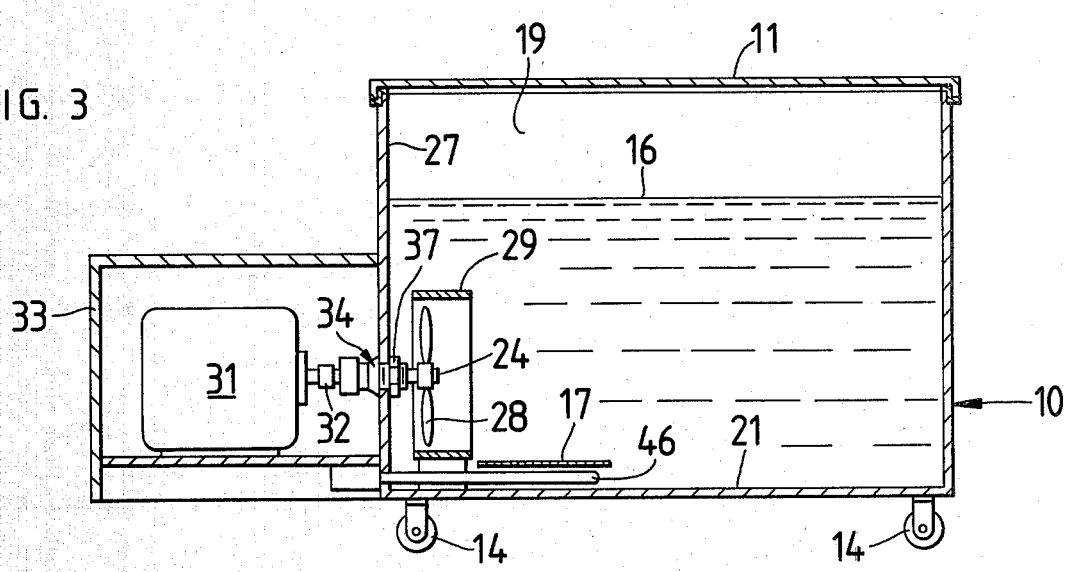

APPARATUS FOR CLEANING MACHINERY PARTS AND THE LIKE

BACKGROUND OF THE INVENTION

This invention relates to apparatus for cleaning machinery parts and the like and more particularly to apparatus for cleaning parts such as engines, transmissions, carburetors, nuts, bolts and the like.

Heretofore in the art to which my invention relates various methods and devices have been devised for cleaning machinery parts. Difficulties have been encountered with such devices due to the fact that they require a considerable amount of time and effort. That is, large parts of machinery, such as transmissions are usually cleaned by submerging them in a conventional acid type cleaning solution for extended periods of time until the coating of dirt, oil and grease becomes loose. The parts are next removed from the cleaning solution and then thoroughly wire brushed and rinsed with high pressure water or steam to remove the loose oil and dirt. This method of cleaning is very inefficient and expensive since it requires a considerable amount of labor. Also, where high pressure steam is utilized, it requires an available source of steam.

SUMMARY OF THE INVENTION

In accordance with my invention, I overcome the above and other difficulties by providing apparatus for cleaning machinery parts which is simple of construction and very economical in its manufacture. My apparatus is adapted to clean machinery parts in a minimum of time and with more reliability than conventional devices, heretofore employed. Also, my apparatus is very inexpensive to operate since it requires a minimum of rinsing after removal from the cleaning solution. My improved apparatus embodies a closed chamber adapted to receive a cleaning solution and the parts to be cleaned. A shaft extends inwardly of the chamber through an opening in a sidewall thereof and carries a propeller at its inner end which rotates within the chamber in position to circulate the cleaning solution in a generally horizontal plane relative to the parts to be cleaned. A heating element is mounted subjacent the propeller for heating the cleaning solution. An improved seal assembly is provided between the opening in the sidewall of the chamber and the shaft to form a fluid tight seal therebetween.

DESCRIPTION OF THE DRAWINGS

Apparatus embodying features of my invention is illustrated in the accompanying drawings, forming a part of this application, in which:

FIG. 1 is a side elevational view of my apparatus showing the chamber closed with the parts to be cleaned omitted for the sake of clarity;

FIG. 2 is a horizontal sectional view taken generally along the line 2—2 of FIG. 1;

FIG. 3 is a vertical sectional view taken generally along the line 3—3 of FIG. 1.

DETAILED DESCRIPTION

Figure 4:
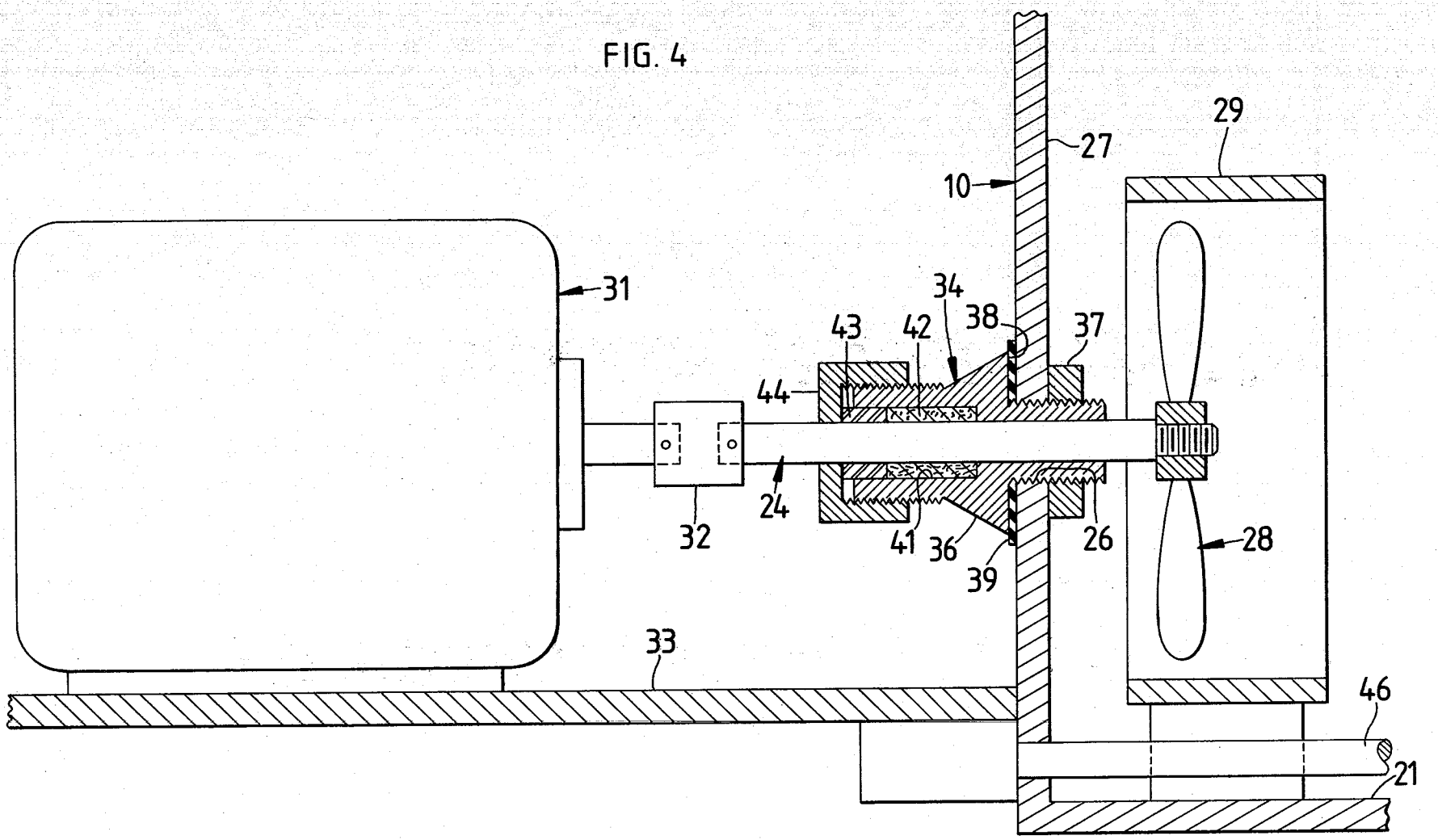
FIG. 4 is an enlarged fragmental, sectional view showing the sealing assembly interposed between the chamber and shaft.

Referring now to the drawings for a better understanding of my invention, I show in FIGS. 1, 2 and 3 a closed fluid tight chamber 10, which may be of a generally box-like shape having a top cover 11. The cover 11 is shown as being pivotally connected to the chamber 10 by a suitable hinge connector 12. However, it will be apparent that the cover 11 may be attached by other means. A handle 13 is carried by the cover 11 to facilitate opening and closing the cover. Pairs of spaced apart rollers 14 are carried by the bottom of the chamber 10 whereby the cleaning apparatus is portable for movement to selected positions.

The fluid tight chamber 10 is adapted to receive a predetermined volume of a conventional cleaning solution indicated at 16 in FIG. 3. The solution 16 is of a conventional type which includes a suitable solvent. In actual practice, I have found that a cleaning solution composed of a mixture of approximately forty-nine parts by volume water to one part by volume of a conventional bio-degradable alkaline base solvent is satisfactory in every respect.

A support member 17 extends between two oppositely disposed sidewalls 18 and 19 respectively, of the chamber 10 and superjacent the bottom, indicated at 21 in FIGS. 2 and 3. The support member 17 may be in the form of a grid member having openings 22 therethrough. The support member 17 is mounted above the bottom 21 in position to support the parts being cleaned above the bottom. That is, one end of a transmission may be supported by the member 17 with its other end resting on the bottom 21 to permit the cleaning solution 16 to completely surround and contact all the surfaces to be cleaned. Also, small machinery parts may be placed on the support member 17 to permit complete surface contact and better cleaning.

As shown in FIG. 4, a propeller shaft 24 extends through and is mounted for rotation within an opening 26 in a sidewall 27 of the chamber 10. The opening 26 is offset from the center of the sidewall 27 and near the bottom 21, as shown in FIGS. 2 and 3. A propeller 28 is mounted on the inner end of the shaft 24 within the chamber 10 rearwardly of the support member 17 and below the level of the cleaning solution 16 whereby the cleaning solution is circulated in a generally horizontal plane relative to the parts to be cleaned. A shroud 29, supported by the bottom 21 surrounds and protects the propeller 28 from possible contact with the parts to be cleaned and also increases the thrust imparted to the cleaning solution by the propeller.

A drive unit, such as an electric motor 31, is operatively connected to the outer end of the shaft 24 through a coupling 32 as shown. In actual practice I have found that for an approximately 9 cubic foot chamber 10, a 3 h.p. motor rotating the propeller 28 at approximately 3500 rpm is satisfactory for proper circulation. A protective housing 33 may be attached to the sidewall 27 of the chamber 10 to cover the motor 31 for safety to reduce noise and provide a neater appearance.

A packing gland assembly, shown generally at 34, is interposed between the opening 26 in the sidewall 27 and the shaft 24 to form a fluid tight seal therebetween. The assembly 34 embodies a sleeve-like member 36 adapted to receive the shaft 24 with one end thereof extending through and in threaded engagement with the opening 26 and a nut 37 as shown. An outwardly extending radial shoulder 38 is carried by the sleeve-like member 36 adjacent the outer surface of the sidewall 27. An annular sealing member 39 is interposed between the shoulder 38 and the adjacent outer surface of the sidewall 27, as shown, to form a fluid tight seal between the opening 26 and the sleeve-like member 36.

An enlarged diameter axially extending recess 41 is provided in the outer end of the sleeve-like member 36, as shown. A packing gland 42 is carried within the recess 41 in position to contact the shaft 24. A gland follower 43 is also carried by the recess 41 adjacent the outer end of the packing gland 42 as shown in FIG. 4. A retainer member 44 is threadedly connected to the outer end of the sleeve-like member 36 and has an opening therethrough adapted to receive the shaft 24 as shown. The member 44 also engages the outer end of the gland follower 43 to urge it inwardly toward the packing gland 42 whereby it is urged into rotating engagement with the shaft 24 to thus form a fluid tight seal therebetween. Upon rotation of the retainer member 44 in a direction to move it toward the gland follower 43, it rotates in the direction of rotation of the shaft 24. Accordingly, the retainer member 44 has a tendency to remain firmly engaged with the gland follower 43. The packing gland 42 is thus urged axially and inwardly whereby it is in turn urged toward the shaft 24 to form a self-adjusting packing gland assembly.

A conventional heating element 46 is mounted within the chamber 10 subjacent and forwardly of the propeller 28 and between the support member 17 and the bottom 21, as shown in FIGS. 2 and 3. The heating element 46 is adapted to heat the cleaning solution 16 to a temperature of up to 210°. In actual practice I have found that my apparatus operates satisfactorily in every respect where the cleaning solution is maintained at a temperature ranging from approximately 130° to 210° F. Preferably, I maintain the cleaning solution at a temperature ranging from approximately 160° to 200° when cleaning a conventional transmission. At this temperature range, the length of the cleaning cycle is approximately 15 to 20 minutes. The length of the cleaning cycle varies inversely with changes in the temperature of the solution. That is, with the temperature of the solution decreased to approximately 160° F., the length of the cleaning cycle is approximately 20 minutes. On the other hand, with the temperature increased to approximately 200° F., the length of the cycle is approximately 15 minutes. When the cleaning solution is maintained at approximately 130°, the length of the cleaning cycle is approximately 30 to 40 minutes.

A conventional thermostat 47 is mounted on the outer surface of the sidewall 27, as shown in FIG. 3. The thermostat is operatively connected to the heating element 46 so as to maintain the cleaning solution 16 at a predetermined temperature set by the user.

From the foregoing description, the operation of my improved cleaning device will be readily understood. First, a predetermined amount of the cleaning solution 16 is placed in the chamber 10. The parts to be cleaned are then submerged in the cleaning solution and supported by the support member 17. The thermostat 47 maintains the solution 16 at a desired cleaning temperature by controlling the heating element 46. With the cleaning solution 16 heated to the desired temperature, the propeller 28 is activated to circulate the solution 16 for a predetermined time period. When the cleaning cycle is completed, the parts are removed from the chamber 10 and lightly rinsed to remove the cleaning solution and any materials carried thereby, such as oil, grease, dirt or the like.

From the foregoing, it will be seen that I have devised an improved apparatus for cleaning machinery parts and the like which is simple and sturdy of construction and manufacture. Also, my apparatus is adapted to clean machinery parts very quickly and efficiently and without the necessity of extensive wire brushing and the use of high pressure water or steam rinsing. Furthermore, my apparatus is adapted to use a biodegradable cleaning solvent which allows the user to dispose of it by conventional methods as compared to acid type solvents used in conventional soaking methods which must be disposed of by environmentally controlled processes.

While I have shown my invention in but one form, it will be obvious to those skilled in the art that it is not so limited, but is susceptible of various changes and modifications without departing from the spirit thereof.

What I claim is:

1. Apparatus for cleaning machinery parts and the like comprising:

(a) a closed chamber having a cover therefor and adapted to receive a cleaning solution and the machinery parts to be cleaned, (b) a propeller shaft extending through and mounted for rotation within an opening in one side wall of said chamber in offset relation to the center of said one side wall with said shaft being below the level of said cleaning solution in said chamber, (c) a propeller mounted on said shaft within said chamber for circulating said cleaning solution in a generally horizontal plane relative to said machinery parts to be cleaned, (d) a sleeve-like member having one end thereof extending inwardly through said opening and operatively connected to said one sidewall and with said sleeve-like member receiving said shaft, (e) an outwardly extending radial shoulder carried by said sleeve-like member adjacent the outer surface of said one sidewall, (f) an annular sealing member interposed between said shoulder and said adjacent outer surface forming a fluid tight seal therebetween, (g) an enlarged diameter axially extending recess provided in the outer end of said sleeve-like member, (h) a packing gland carried by said recess and surrounding the outer surface of said shaft, (i) a gland follower carried by the outer end of said recess, (j) a retainer member threadedly connected to the outer end of said sleeve-like member and having an opening therethrough for receiving said shaft, with rotation of said retainer member in a direction to move it toward said gland follower being in the direction of rotation of said shaft to thus maintain a fluid tight seal therebetween, and (k) heating means mounted within said chamber and immersed in said cleaning solution subjacent said propeller for heating said cleaning solution.

2. Apparatus as defined in claim 1 in which said heating means maintains said solution at a temperature ranging from approximately 130° to 210° F.

3. Apparatus as defined in claim 1 in which said heating means maintains said solution at a temperature ranging from approximately 160° to 200° F.

* * * * *